US011974675B1

(12) United States Patent
Kemnitzer et al.

(10) Patent No.: US 11,974,675 B1
(45) Date of Patent: May 7, 2024

(54) SEATING ASSEMBLY

(71) Applicant: Kemnitzer/Powel, LLC, Roanoke, VA (US)

(72) Inventors: Ronald B Kemnitzer, Roanoke, VA (US); Jane B Powell, Roanoke, VA (US)

(73) Assignee: Kemnitzer/Powell, LLC, Roanoke, VA (US)

( * ) Notice: Subject to any disclaimer, the term of this patent is extended or adjusted under 35 U.S.C. 154(b) by 0 days.

(21) Appl. No.: 18/388,404

(22) Filed: Nov. 9, 2023

(51) Int. Cl.
*A47C 1/16* (2006.01)
*A47C 7/02* (2006.01)

(52) U.S. Cl.
CPC ..... *A47C 7/021* (2013.01)

(58) Field of Classification Search
CPC ..... A47C 7/02
USPC ..... 297/219.1, 352, 452.21
See application file for complete search history.

(56) References Cited

U.S. PATENT DOCUMENTS 1,343,594 A * 6/1920 Stubblebine ..... B61D 33/0035 297/452.21 X
2,715,434 A * 8/1955 Lukens ..... A47C 7/56 297/219.1
3,113,326 A * 12/1963 Hyde ..... A47C 31/105 297/219.1 X
3,463,547 A * 8/1969 Brennan ..... A47C 7/029 297/219.1 X
3,603,639 A * 9/1971 Wilson ..... B60N 2/24 297/219.1 X
4,611,852 A * 9/1986 Filer ..... A47C 1/16 297/352
5,288,135 A * 2/1994 Forcier ..... A61G 5/1064 297/452.21 X
5,368,360 A * 11/1994 Groh ..... A47C 7/021 297/219.1
5,456,519 A * 10/1995 Davis ..... A47C 7/029 297/219.1 X
5,505,517 A * 4/1996 Groh ..... A47C 7/0213 297/219.1
5,513,896 A * 5/1996 Groh ..... A47C 1/16 297/219.1
5,551,107 A * 9/1996 Graebe ..... A47C 4/54 5/653

(Continued)

FOREIGN PATENT DOCUMENTS

DE 202012004743 U1 * 8/2012 ..... A47C 7/021
FR 2778097 A1 * 11/1999 ..... A47C 7/021

*Primary Examiner* — Rodney B White
(74) *Attorney, Agent, or Firm* — Woods Rogers PLC; Timothy Bechen

(57) ABSTRACT

A seating element as noted herein, is attachable to a folding metal chair, the seating element includes a base portion having front, back, and side edges. The base portion includes an articulating shape from the front edge to the back edge including a convex arcuate rise and fall combined with a concave arcuate descension blending into a flat surface of the base portion such that the front edge of the base portion is lower in height than the back edge of the base portion. The back wall is disposed at the back edge and a front wall is disposed at the front edge. The bottom edges of the base portion are attached to descending outer side walls. The seating element is securable to the metal folding chair by engagement at least two of the back wall, front wall, and side walls over a seat of the chair.

16 Claims, 7 Drawing Sheets

(56) References Cited

U.S. PATENT DOCUMENTS

| | | | | |
|---|---|---|---|---|
| 5,613,257 | A * | 3/1997 | Graebe | A47C 27/148 5/653 |
| 5,779,317 | A * | 7/1998 | Neal | A47C 7/40 297/452.21 X |
| 5,833,319 | A * | 11/1998 | Davis | A47C 7/425 297/452.21 X |
| 5,921,626 | A * | 7/1999 | Baker | A47C 7/021 297/219.1 |
| 5,950,263 | A * | 9/1999 | Hanson | A61G 5/1045 297/452.21 |
| 6,182,344 | B1 * | 2/2001 | Holland | B25B 27/0092 297/219.1 X |
| 6,839,928 | B1 * | 1/2005 | Woodall | A47C 5/125 5/656 |
| 7,108,330 | B2 * | 9/2006 | Mizelle | A47C 4/24 297/219.1 |
| 7,275,788 | B2 | 10/2007 | Dettmann et al. | |
| 7,347,498 | B2 * | 3/2008 | Clifford | A47C 7/029 297/452.21 X |
| 7,806,476 | B2 * | 10/2010 | Forgatsch | B60N 2/62 297/452.21 |
| 7,926,880 | B2 * | 4/2011 | Heidmann | A47C 7/54 297/452.21 |
| 8,499,388 | B1 | 8/2013 | Copes | |
| 8,990,985 | B1 * | 3/2015 | Wilhelm | B60N 2/7017 5/653 |
| 11,147,379 | B2 | 10/2021 | Smith et al. | |
| 2011/0095581 | A1 * | 4/2011 | Pierce | A47C 7/0213 297/219.1 X |
| 2016/0073798 | A1 * | 3/2016 | Pawlikowski | A47G 9/0246 297/219.1 |
| 2017/0320551 | A1 * | 11/2017 | Dennehy | A47C 7/18 |
| 2022/0287463 | A1 | 9/2022 | Chan et al. | |

* cited by examiner

SEATING ASSEMBLY

COPYRIGHT NOTICE

A portion of the disclosure of this patent document contains material that is subject to copyright protection. The copyright owner has no objection to the facsimile reproduction by anyone of the patent document or the patent disclosure as it appears in the Patent and Trademark Office patent files or records, but otherwise reserves all copyright rights whatsoever.

RELATED APPLICATIONS

There are no related applications.

FIELD OF INVENTION

The present invention relates generally to a seating apparatus and more specifically to an attachment element securable over the seat of a standard metal folding chair for improving usability of the chair.

BACKGROUND

There is a growing demand for chair-based activities, accommodating individuals with mobility issues wishing to remain active. For example, many activities include chair-versions, such as chair aerobics, chair yoga, and chair tap-dancing.

Folding metal chairs are ubiquitous, commonly used in a variety of locations, including gyms, community centers, schools, churches, and other spaces, including homes. Designed for general seating, these folding metal chairs fail to provide ergonomic features that encourage erect posture and core stability. One negative factor is the chair surfaces being hard and cold to the touch as well as being difficult to maintain postural position or controlled movement due to the slippery metal seating surface. Another factor is that the seats typically slant downward from front to back. A typical downward angle is in a range between four and six degrees. It is this angle that is largely responsible for the user's pelvis to rotate forward, moving the coccyx toward the front edge of the seat. This, in turn, compresses the user's diaphragm, reducing their air intake and stamina. As the user's bottom slides forward in the seat, their posture is increasingly deteriorated. While the resulting discomfort and fatigue are bad enough in casual sitting applications, they are exaggerated in situations where maintaining a vertical core is essential, such as exercising or playing music.

These metal folding chairs offer low-cost options for facilities managing expenses, but these chairs have significant limitations for users with mobility issues. Another problem with these existing chair seats arises from the user engaging in various movement activities. Not only is the seat surface uncomfortable but does not include any hand grips or other elements assisting the user in movement. For instance, if the user already has limited mobility, the user in a metal folding chair can have difficulty shifting his or her weight across a centerline or performing a bodyweight movement such as trying to lift their posterior off the seat using only their arms or even stand up from a seating position.

While dedicated chairs for exercise and music are available, they are expensive and are not often found in the public venues where classes, practices, and performances are held. Individuals taking classes such as chair aerobics or music classes are forced to adapt to the chairs provided by the venue, most often these are standard folding metal chairs. Those people desiring or needing a more ergonomic solution are forced to either purchase and transport an expensive and heavy dedicated purpose chair to those venues or take a pillow or other special device to make a folding metal chair more effective or at least comfortable. Carrying a chair to a venue can be difficult for a person who is physically impaired or also carrying a musical instrument. Musicians that are engaged by multiple venues are especially vulnerable to being forced to perform on inadequate chairs.

There are existing techniques for improving the comfort or cushion of a standard chair, but none of these solutions relate to improving use of the chair for music performance, exercise, or other fitness-related activities. For example, U.S. Pat. No. 8,499,388 describes a chair pad that fits over a standard folding chair base. This patented solution merely uses a foam padding within a protective cover and a lower pocket that slides over the front portion of the chair seat. All this patented solution does is provide extra padding on an otherwise uncomfortable chair.

Another example is U.S. Pat. No. 7,275,788 disclosing music posture chairs. These solutions of manufactured chairs having legs, base, and back are designed exclusively to improve the user's sitting posture. These solutions are primarily used for professional settings, such as concert facilities and recording studios. These solutions are expensive and not a viable option for many gyms, community centers, churches, clubs, or other organizations that offer music practice/performance, and health and mobility services. These solutions are also extremely heavy and not a reasonable solution for an individual to purchase a chair and bring the chair with him or her to an exercise class or music performance.

As such, there exists a need for a solution allowing for the modification of standard metal folding chairs to facilitate and improve user posture and ensuring the safety of the user whilst using chair for a physical activity.

BRIEF DESCRIPTION

The invention cures the prior art limitations by providing a seating element attachable to a chair, such as a standard metal folding chair. The seating element includes a base portion having a front edge, a back edge, a first inner side edge and a second inner side edge. The top surface of the base portion articulates in a wave-like shape from the front edge towards the back edge including an arcuate rise and an arcuate descension. Moreover, the front edge of the base portion is lower in height than the back edge of the base portion.

The seating element includes a descending back wall extension disposed at the back lower edge of the base portion edge as well as a descending front wall extension disposed at the front lower edge of the base portion. Both of these descending walls extend beyond the bottom surface of the base portion. The seating element is securable to the chair by engagement of the descending back wall and the descending front wall over corresponding surfaces of the metal folding chair seat.

In all embodiments, the front edge of the base portion is lower in height than the back edge such that when disposed on the chair, the typical front-to-back downward sloping surface of a folding metal chair seat (4°-6°) is neutralized.

In varying embodiments, the seating element may further include left and right descending outer side wall(s), such that the element is further secured from side-to-side movement relative to the folding chair seat.

In varying embodiments, the seating element further includes one or more hand grips disposed on the left and/or right inner sidewalls and/or outer side walls at a position and configuration that is conveniently accessible to the user and structurally secure enough to stabilize the user during exercise or exiting the chair.

The wave-like feature of the seating element can further include the arcuate rise and at least a portion of the arcuate descension of the base portion being disposed before a midpoint between the front edge of the base portion and the back edge of the base portion. In varying embodiments, based on the arcuate rise, the arcuate rise can generate a downward slope between the range of 18 degrees and 22 degrees, creating a comfortable "waterfall" front edge of the seat surface that is more ergonomically effective in increasing blood flow to the user's lower legs and increasing user comfort and stamina.

In varying embodiments, the seating element may further include a compression element disposed on top of the seating element extending from the front edge to the back edge. In varying embodiments, the compression element can be one or more cushions or other attachments. For example, the cushion could be upholstered with fabric or vinyl-type material. In another example, the compression element can be molded using an elastomeric material such as urethane foam. Various thicknesses and durometers (softness/hardness) are available and within the scope herein, balancing user comfort as well as aiding in mobility and usability of the seating element when affixed to a standard chair. The compression element can be removeable, washable, or made of a material inhibiting sweating or stains.

In varying embodiments, the seating element can include at least one carrying handle extending outward from the back wall. The carrying handle allows for a user to carry the seating element, bringing the seating element with them for an exercise class, performing at a concert, or any other suitable use.

The seating surface of the proposed invention features a "wave" configuration that starts at the front edge of the metal folding chair seat at an approximate 13.6" convex radius and rises approximately 1.875 inches at a point approximately 6 inches from the front edge and then descends, blending into an approximate 15.3" concave radius that then blends into the rear surface of the seat pad that is parallel to the bottom edge of the base portion. This "wave" configuration encourages the user's pelvis to rotate in a direction that moves their coccyx toward the back edge of the seat. This, in turn, aligns the user's core, releases their diaphragm, and increases their air intake. Demonstration of this phenomenon can be experienced by slightly lifting your feet while sitting in any chair. You will feel your pelvis rotate backwards and your spine straighten. The front portion of this "wave" corresponds to an approximate 20° downward slope which resembles the "waterfall" front edge of most ergonomic chairs that permits user's feet to descend to a lower point, resulting in a more relaxed and stable posture. The rear portion of the wave causes the pelvis to rotate to a correct ergonomic position and the waterfall front edge simultaneously eliminates pinching of the Popliteal Fossa. Such compression of the Popliteal Fossa reduces blood flow which can cause lower leg pain and numbness.

In other embodiments, the seating element is secured to the seat of the metal folding chair by descending sidewalls from the front, back, and two sides of base portion with the two opposing outer sidewalls terminating at a point forward of the hinge pin connecting the front-leg/seatback component and the seat pan of the metal folding chair. Together, these four descending sidewalls surround and capture the corresponding sidewalls of the meatal folding chair seat pan, securing the components with no additional fasteners or mechanisms.

The dimension between the inner surfaces of the descending outer sidewalls is approximately 16.125 inches. The outer side walls terminate at a point approximately 8" from the front edge of the base portion, exposing the two inner side walls, whose maximum outside to outside edges measures no more than 15.25 inches, a parameter that enables the base portion to fit between the leg module uprights of most metal folding chairs.

Attaching and removing the seating element to a metal folding chair is quick and easy. The user simply inserts the device between the two front legs of the chair above the seat and guides it rearward to a position directly above the seat, then lowers the device over the seat with the device sidewalls surrounding the perimeter of the metal seat and then allowing the device to slide down over the metal seat where it is prevented from any side-to-side or front-to-back movement. To remove the device, the sequence is reversed; simply by lifting the device vertically until it clears the metal seat and then moving it out between the front leg/seatback assembly and carrying it to the next destination.

In other embodiments of the seating element is a handle feature attached to the rear edge of the device. This feature facilitates the carrying of the device, storage (hanging by handle) and attachment/removal to/from a metal folding chair.

In other embodiments of the seating element are two hand grip structures protruding from the forward area of each side panel. These structures provide a shape for the user to grasp and stabilize themselves as they engage in various aerobic exercises. This feature would be especially effective for very large users who cannot easily grasp the side edges of a folding metal chair seat pan because of their body girth or other mobility issues.

In other embodiments of the seating element is a shallow recessed area on the top surface of the structure that provides an area for attachment of a seat cushion. This cushion could be permanently attached or, alternately, be removable for cleaning. This cushion could be upholstered with fabric or vinyl-type material or be molded using an elastomeric material such as urethane foam. Various thicknesses and durometers (softness/hardness) would be possible. This cushion feature also offers the opportunity to customize the product with color, pattern, logos, or textures, providing individual aesthetic expression.

A better understanding of the disclosed technology will be obtained from the following detailed description of the preferred embodiments taken in conjunction with the drawings and the attached claims.

DETAILED DESCRIPTION

Figure 1:
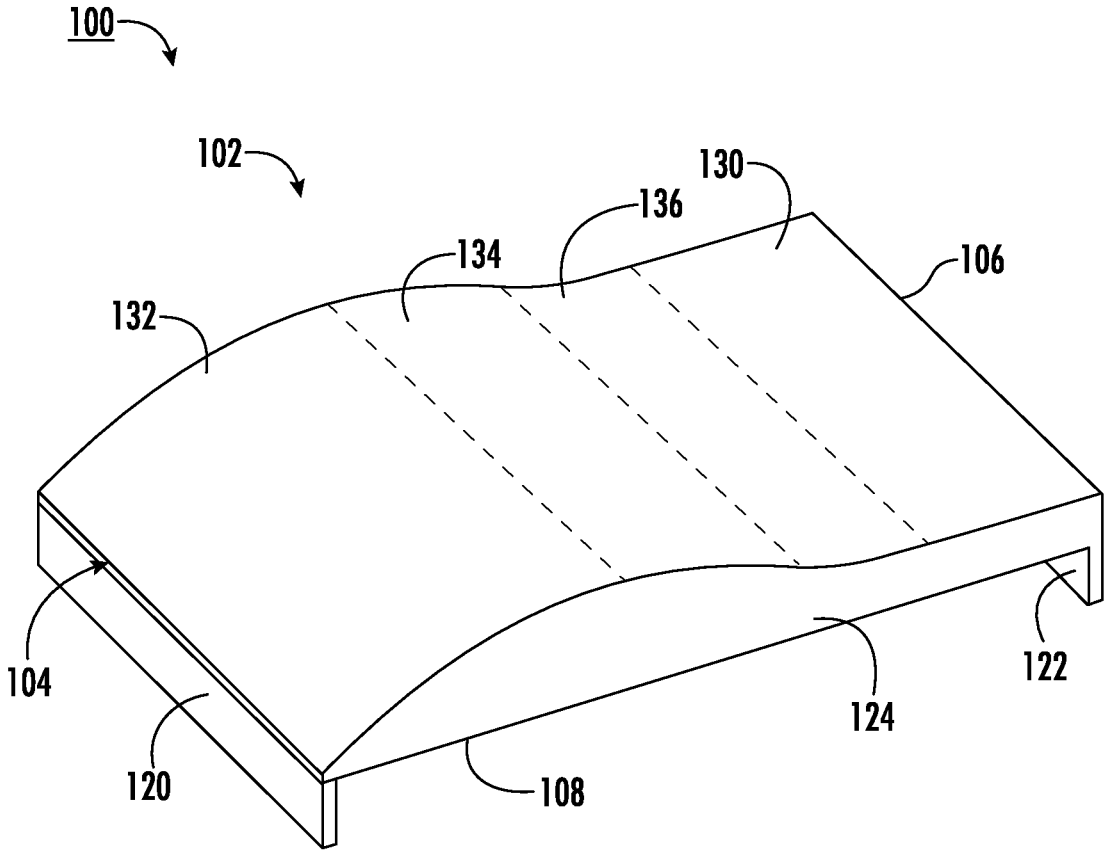
FIG. 1 illustrates a perspective view of the base portion of the seating element.

FIG. 1 illustrates a perspective view of one embodiment of a seating element 100, illustrating specifically the base portion 102 with a front edge 104, a back edge 106, a first side edge 108 and a second side edge (not shown).

While not fully visible in FIG. 1 because of the perspective view, the base portion 102 has a limited thickness, whereby the front edge 104 includes a descending front wall 120 that extends downward from the base portion 102. The back edge 106 includes a descending back wall 122 extending downward from the base portion 102. As illustrated in further detail below, the descending front wall 120 and the descending back wall 122 can encompass a front edge and a back edge of a standard metal folding chair seat securing the seating element thereon. The base portion 102 of the chair is no wider than 15.250", a parameter that enables the base portion to fit between the leg module uprights of most metal folding chairs.

FIG. 1 further illustrates inner side walls, the first inner side wall 124 visible. Further visible in FIG. 1, the base portion 102 includes an arcuate shape as well as a flat portion 130. The top surface of base portion 102 includes a front section of rising in a convex arcuate rise 132 from the front edge. The convex arcuate rise 132 crests and then descends 134 towards approximate front-to-back mid-point of the seat assembly 100 where it blends into a descending concave arcuate portion 136 that continues until it meets and blends into the flat portion 130.

Figure 2:
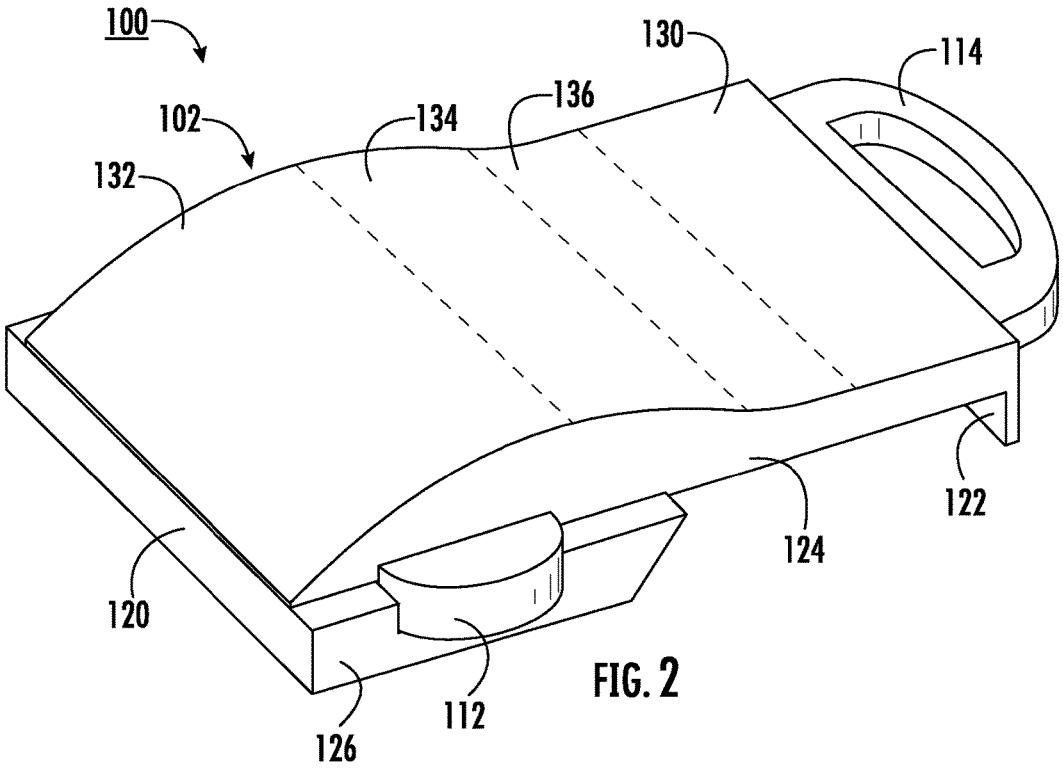
FIG. 2 illustrates a perspective view of one embodiment of a seating element including descending front wall and descending outer side walls, a descending back wall and hand grips.

FIG. 2 illustrates a preferred embodiment of the seating element 100 that further includes left and right descending outer side wall(s) 126, each parallel to the corresponding inner side walls 124 such that the seating element is further secured from side-to-side movement relative to the folding chair seat. In order to engage with a typical steel folding chair seat, the space between these two outer sidewalls must be no less than 16.125". In order to achieve this spacing between the outer sidewalls, the bottom left and rights edges of the base portion 102 must extend outwardly in a horizontal direction approximately 0.313" and then descend vertically while maintaining a distance of no less than 16.125" between the inside surfaces of these walls. These outer side walls extend from the front edge of. the base portion towards the back edge for a distance of approximately 8" terminating at a forward sloping angle of approximately 30 degrees from vertical towards the front of the seating element. This configuration of the back edge of the outer side walls prevents them from interfering with the front-leg assembly of the steel folding chair.

Visible in FIG. 2, a hand grip 112 extends outward from the inner side walls 124 and/or the outer side walls 126. The hand grips 112, either individually or in combination with a hand grip on the opposite side, offers a grip or other support for a user to both position and maneuver themselves while sitting on the chair element having the seating element secured thereon. Additionally, for individuals having a larger girth or mobility concerns, the handle(s) offer additional level of support and security in using the seating element in concert with a folding chair.

The carrying handle 114, disposed on the back wall 122 of the base portion, allows a user to carry the seating element 100 when not in use. For instance, if an organization offers a chair aerobics class and provide standard metal folding chairs, the user can bring his or her own seating element to class, similar to a person bringing his or her own yoga mat to a yoga class. The handle 114 provides for ease of carrying, as well as well as placement over an existing folding chair. Thus, a facility can use existing, standard, folding chairs for a class, with individuals either being offered or bringing their own seating elements.

FIG. 2 further illustrates the base portion 102 including the arcuate shape as well as the flat portion 130. The base portion 102 includes the front section of rising in the convex arcuate rise 132 from the front edge. The arcuate rise 132 crests and then descends 134 towards approximate front-to-back mid-point of the seat assembly 100 where it blends into the descending concave arcuate portion 136 that continues until it meets and blends into the flat portion 130 at a point approximately 13.125" from the front edge of the base portion.

The curvature formed by the arcuate rise 132 and arcuate descension 134 starts at the front edge of the metal folding chair seat at a convex radius at approximately 13.5 inches within a standard tolerance. The curvature rises approximately 1.75 inches at a point approximately 6.5 inches from the front edge before descending, blending into an approximate 15.4 inches concave radius at a point approximately 10 inches from the front edge base portion 102 where it blends into the flat surface 130 of the base portion 102 that is parallel to the bottom edge of the base portion at a point approximately 13.125 inches from the front end of the base portion.

This wave-like configuration encourages the user's pelvis to rotate rearward, moving their coccyx toward the back edge of the seat. This, in turn, aligns the user's core, releases their diaphragm, and increases their air intake. The front portion of this "wave" corresponds to an approximate 20 degrees downward slope which resembles the "waterfall" front edge of most ergonomic chairs that permits user's feet to descend to a lower point, resulting in a more relaxed and stable posture. In varying embodiments, the downward slope can be between a range of 17.5 degrees to 22.5 degrees downward slope.

The seating element 100 can be made out of a variety of materials, including but not limited to plastic resins, expanded foam, or any other suitable material. The material of the seating element 100 provides structure and rigidity for the benefits noted herein, but limit weight as well as manufacturing costs. As noted below, the seating element can be composed of any number of varying embodiments, including but not limited to, a composite material, molded plastic, three-dimensional printing, cushioning material such as urethane foam, or other suitable materials. The seating element 100 can be produced as a one-piece molded structure or an assembly of two or more components.

In an embodiment of the seating element 100 comprised of two or more components, individual components can be of different materials. For example, the handle 114 could be made of wood, metal, plastic, fabric, rubber, or other material. The hand grips 112 could also be produced in similar materials. Other advantages of such an embodiment would offer functional advantages such as non-slip and temperature neutral touch handles and hand grips. These components could also be produced in colors different than the injection molded base portion to improve consumer appeal.

Figure 3:
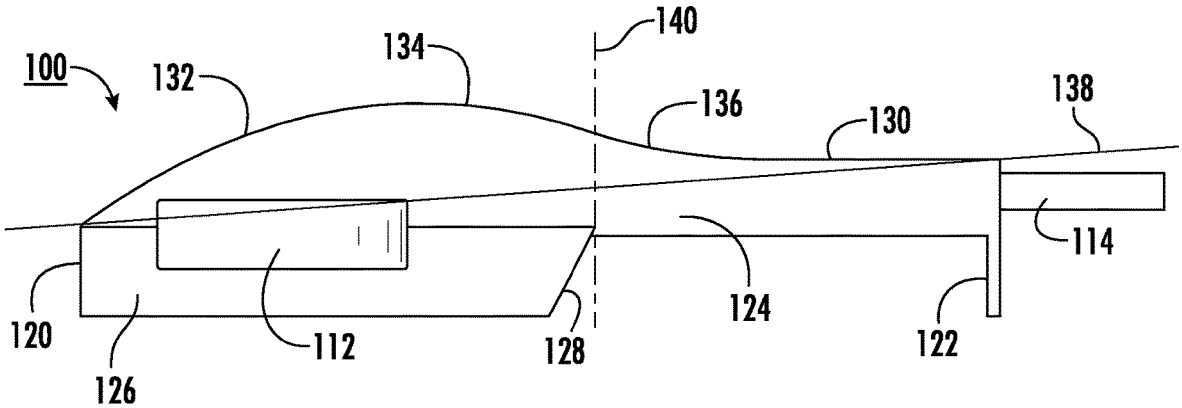
FIG. 3 illustrates a side view of one embodiment of the seating element of FIG. 2.

FIG. 3 illustrates a side view of the seating element 100 of FIG. 2, illustrating the wave-like portion having the convex arcuate rise 132 and the convex arcuate descension 134 that merges with an arcuate concave descension 136 to the flat portion 130. Visible in the side view is the hand grip 112 as well as the inner side wall 124 that extends downward from the seating surface. Also visible is the carrying handle 114 extending outward from the back of the base portion 102. In this embodiment, the outer sidewall 126 attaches to the inner sidewall 124 and terminates approximately 8 inches from the front edge of the base portion 102. The rearward edge 128 of outer sidewall 126 angles forwardly downward at an angle of 30 degrees such that it does not interfere with the front legs of the metal folding chair to which it is attached.

Illustrated in FIG. 3 is a midline 140 of the seating element 100. The midline 140 indicates a middle distance between the front edge of the base portion and the back edge of the seat flat portion 130, also illustrating how the arcuate descension passes through the midline 140 before reaching the flat portion 130.

The side view of FIG. 3 further illustrates an offset angle 138 when the seating element 100 is placed on a folding chair having a forward tilt of the folding metal chair seat. The angle line 138 runs from the front edge to the back edge of the base portion, whereby the slope from the front edge to the back edge is approximately plus 4 degrees. This feature mitigates the minus 4-to-6-degree slope of the metal folding chair seats, making the overall orientation of the seat pad nearly horizontal to the floor on which the metal folding chair rests.

Figure 4:
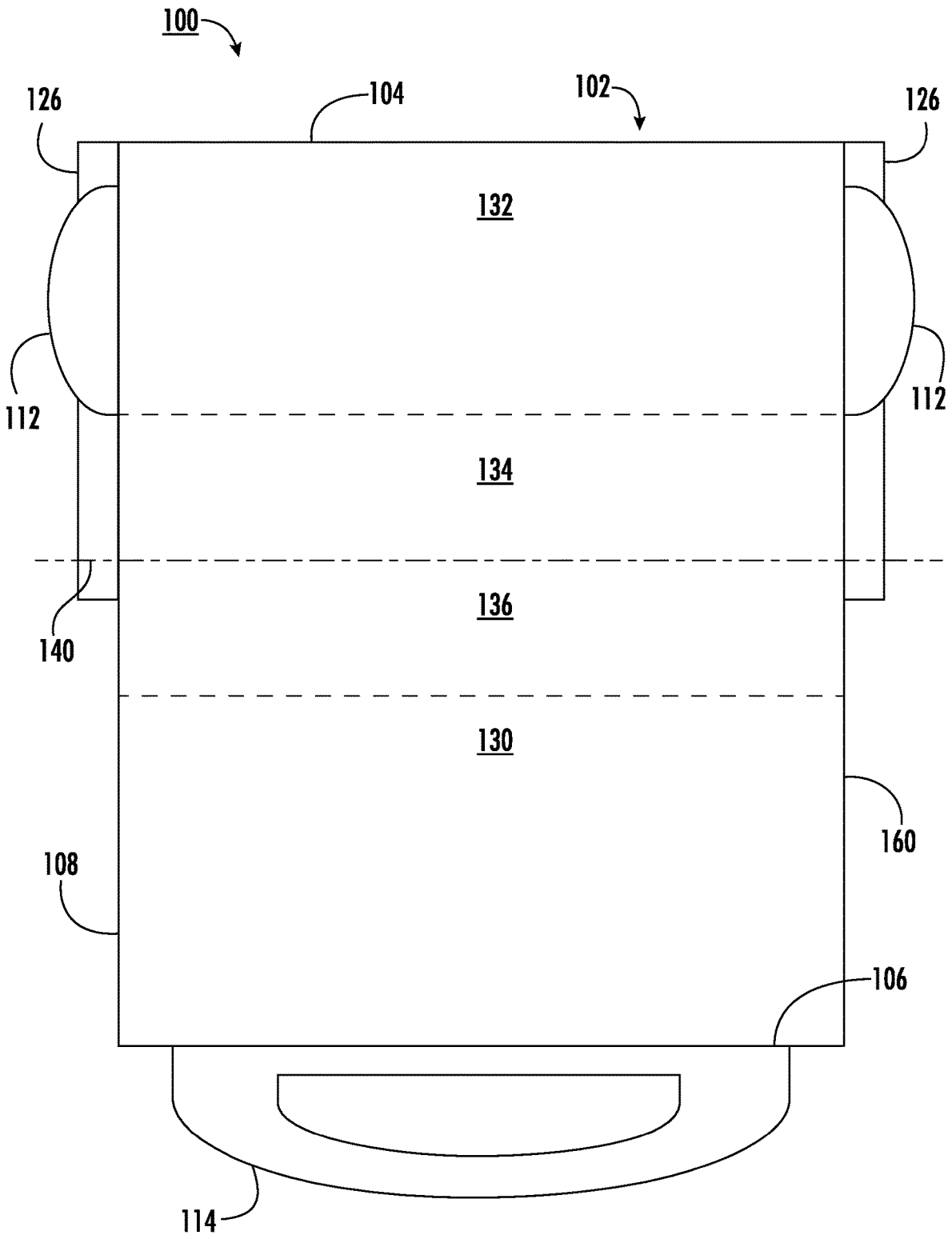
FIG. 4 illustrates a top view of one embodiment of the seating element of FIG. 3.

FIG. 4 illustrates a top view of one embodiment of the seating element 100. FIG. 4 illustrates the base portion 102, front edge 104, back edge 106, and side edges 108 and 160. As illustrated, the hand grips 112 extend outward from the side edges 108 and 160, respectively. Where the base portion 102 is affixed atop a folding chair base, the hand grips 112 extend further outward from the chair, providing additional stability and benefit to the user.

From the top view of FIG. 4, the convex arcuate rise 132 meets the convex arcuate descension 134, which meets the concave arcuate descension 136 near the midline 140, before blending into the flat portion 130. The flat portion 130 extends to the descending back wall 106 and the carrying handle 114 abuts outward therefrom. As illustrated, the handle 114 extends outward from the base portion 102, not interfering with alignment or affixing the base portion 102 to a chair, as well as providing a convenient means for carrying the seating element.

The dimensions of the seating assembly 100 in FIG. 4 are illustrative and not expressly limiting in scope. For example, in a preferred embodiment, the base portion 102 is a square, having the lengths of the front and back being the same as the sides. In another embodiment, the base portion 102 can be rectangular in shape. As noted herein, the sizing of the base portion 102 is governed in part based on the seat and legs of a standard metal folding chair, where square base portion 102 affixes to the metal folding chair having the square seat.

In one embodiment, the seating element can be made of an injection-molding, one-piece device made of a semi-flexible polymer such as polypropylene.

Figure 5:
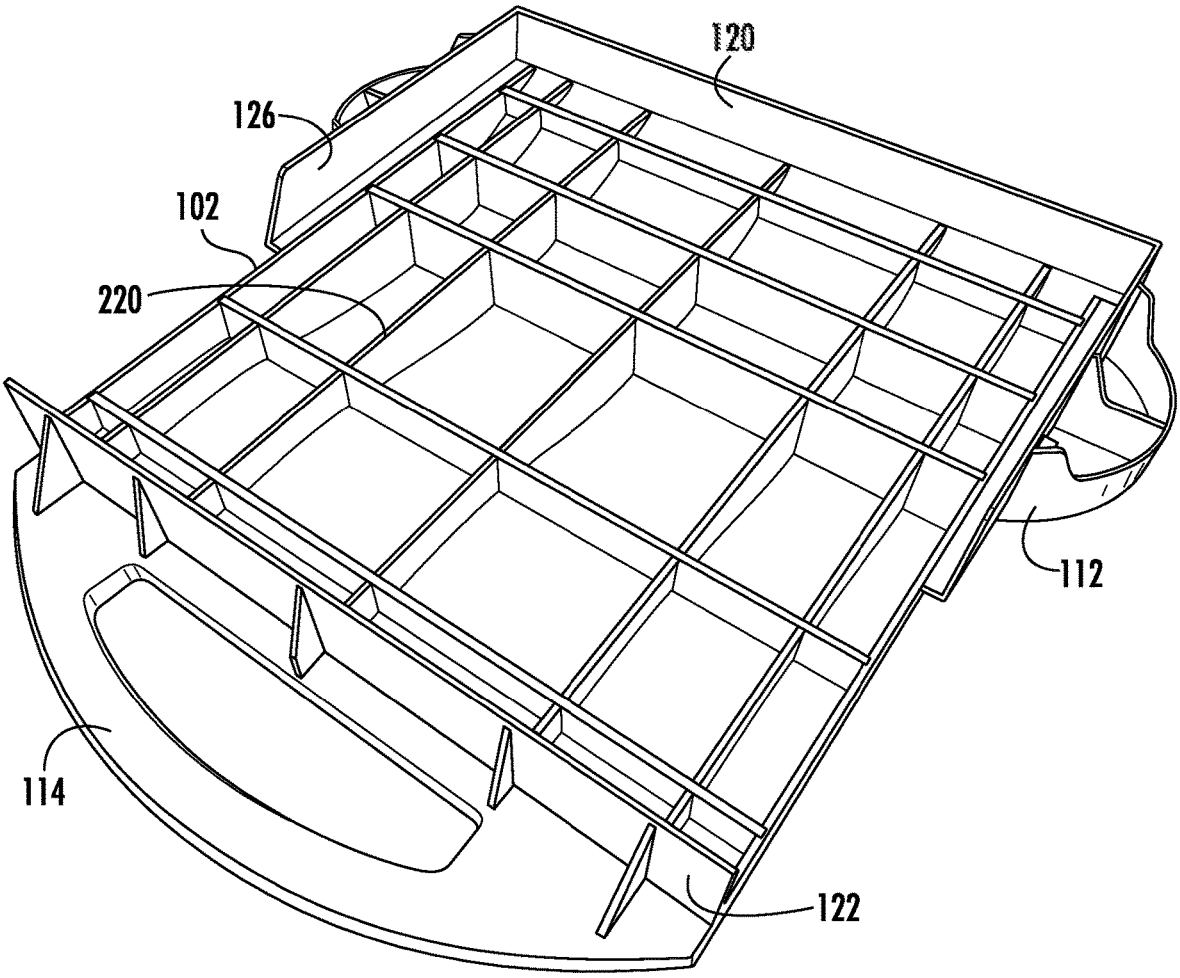
FIG. 5 illustrates one embodiment of the seating element without a cover.

FIG. 5 illustrates one embodiment of a seating element 100 in this embodiment. The injection-molded device can be formed using a descending front wall 120, descending back wall 122, and base portion 102 with reinforcing elements 220 arranged therein. The pattern of reinforcing ribs illustrated in this figure is only suggestive, as the number, configuration, and arrangement of ribs can vary according to structural properties of the molding material, product stiffness preferred, and other factors such as mold flow.

The inherent flexibility of a polypropylene version would enable easier insertion and removal of the device. The combination of one-piece injection molding in polypropylene would result in a low production cost, especially in large quantities. This version would require a structural reinforcement below the seating surface, likely an "egg-crate" reinforcement such as illustrated in FIG. 5.

In another embodiment, the seating element can be formed in a multi-piece construction of separate elements. For example, a 2-piece "clamshell" construction of injection molded polymer of more rigid structural characteristics such as ABS or polystyrene can be used.

In one embodiment, this seating element can include top and bottom sections that each have structural reinforcement ribs similar to the suggested pattern shown in FIG. 5 but can be less robust and/or numerous. The parts can be combined by mechanical means, for example but not limited to screws, tabs, adhesives, or any other suitable means as recognized by a skilled artisan, including for example but not limited to sonic welding.

This embodiment can provide a very finished appearance and feel with no visible ribbing or uncomfortable touch areas. Whereas this embodiment may require higher tooling and production costs. Similar to other embodiments, this embodiment provides for attachment of a seat cushion for the benefit of the user.

Another embodiment provides for the seating element or at least the base portion to be made of an injection molded polyurethane foam or similar material having natural properties of cushioning and flexibility. The material can be molded in different durometers (soft-hard) and can be molded in many different colors either as a solid color or various colors in specific areas. Such in-mold decorating can significantly reduce overall production costs while adding customer appeal. The material can easily be molded in various surface textures, including a texture similar to cloth. The flexibility of the material offers increased sitting comfort and reduces or eliminates the need for a cushion. This flexibility also requires that the sidewalls which secure the device to metal folding chair seats must be thicker than other common plastic materials such as polystyrene and ABS.

Where designed above, the base provides for attachment to the seat. For instance, the front wall and the back wall can descend any suitable distance for extending over the front edge and back edge of the chair, respectively. In one embodiment, the front wall and back wall can abut over the edges of the chair and another embodiment the walls can fully extend down past the chair edges. For instance, as the typical depth of the front edge of a metal folding chair seat is 1¾ inches in depth, descending front wall 104 can be less than 1¾ inches in depth and the front edge of the chair seat is still visible. In another instance, if the front edge of the chair is 1¾ inches in depth, the front edge can be longer than 1¾ inches, whereby the front edge is not visible.

The depth of the front wall and back wall can balance security of engaging the chair, e.g., the seating element not slipping, versus the ease of placement and removal by a user prior to and after use. Where the front wall and/or back wall is less than the depth of the chair edges, the seating element can be more easily installed and removed but may be more prone to slipping during use. By contrast, where in the front wall and/or back wall is longer than the depth of the chair edges, the seating element is more secure but can be more difficult to place and remove by the user, having to lift the seating element up and over the front and/or back walls.

The wall thickness of the injection molded embodiments may vary depending on the material and molding properties selected and will be determined by engineering and manufacturing best practices. For example, molding materials that are more structurally weak may require a thicker wall than a more structurally robust material. In the case of a urethane foam embodiment, wall thicknesses would be much thicker than required for an injection molded styrene embodiment.

Figure 6:
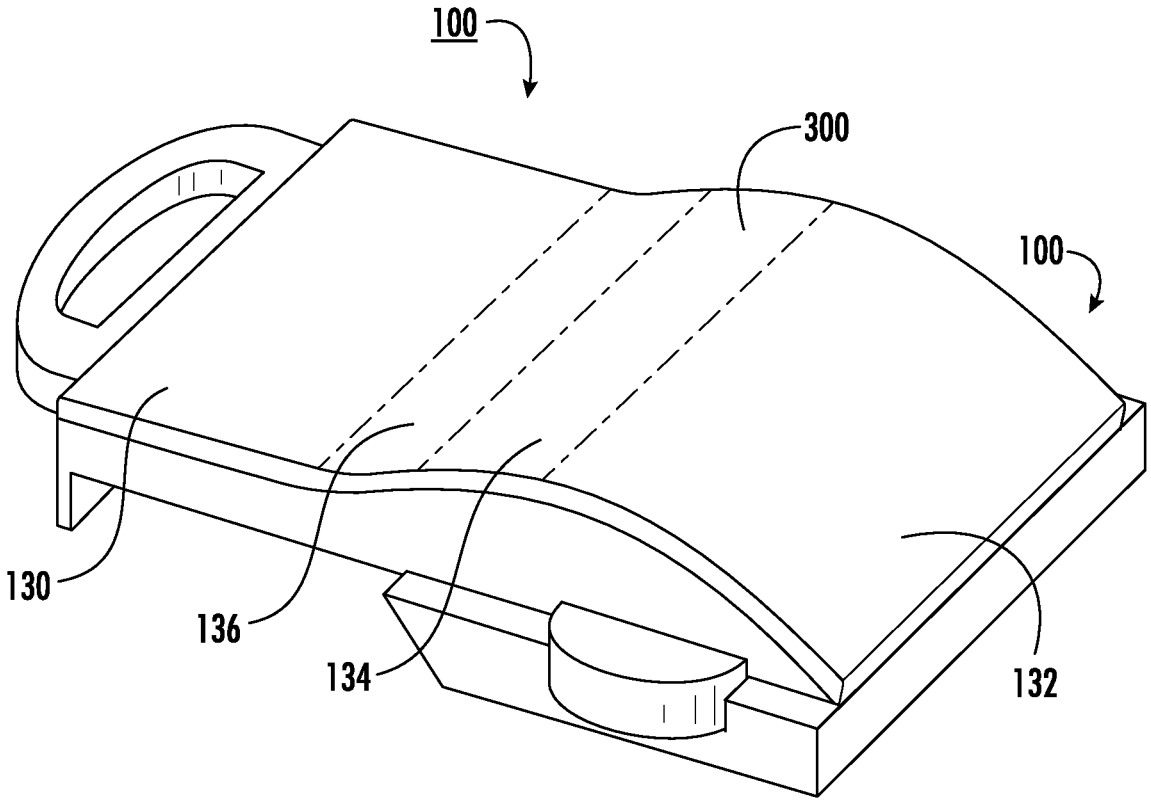
FIG. 6 illustrates view of the setting element having a cover therewith.

FIG. 6 illustrates the seating element 102 with a covering 300 disposed thereon. In the FIG. 6 embodiment, the covering 300 fully covers the top side of the seating element 102, including over the convex arcuate rise 132, the convex arcuate descensions 134, the concave arcuate descension 136, and the flat portion 130. A cover for the urethane foam embodiment may partially or fully envelop the seating element.

The covering 300 can be a soft cushion or any other suitable type of covering, including a permanent or removeable covering. In one embodiment, the covering can be made of a soft pliable material and capable of being removed, such as for cleaning. For instance, if a facility has a set of seating elements for a group exercise class, the facility may wish to remove and launder the cushions. In another instance, the cushions can include a covering made of vinyl or other material for being sprayed with a disinfectant and wiped down between uses.

In one embodiment, the covering 300 can include a logo or other identifier. For instance, the covering 300 can include a logo of the facility or gym. In another instance, the covering 300 can include a sports team or other identifier. In another instance, the covering 300 can include a manufacturer's logo or other branding. In another instance, the covering 300 can include advertising or other promotional elements, for example the seating elements and covers being donated and the donating entity having recognition thereon.

The covering 300 can be permanently affixed, for example using glue or other type of adhesive. The covering 300 can be removeable, for example using a hook-and-loop fastener system or any other suitable technique.

The covering 300 is illustrated as covering the top portion 102, but it is recognized the covering 300 can be partially covering. For instance, one embodiment may include a covering only over the flat portion 130, providing cushion to the user's tailbone but direct contact to the wave-like structure for user movement or other uses.

Figure 7:
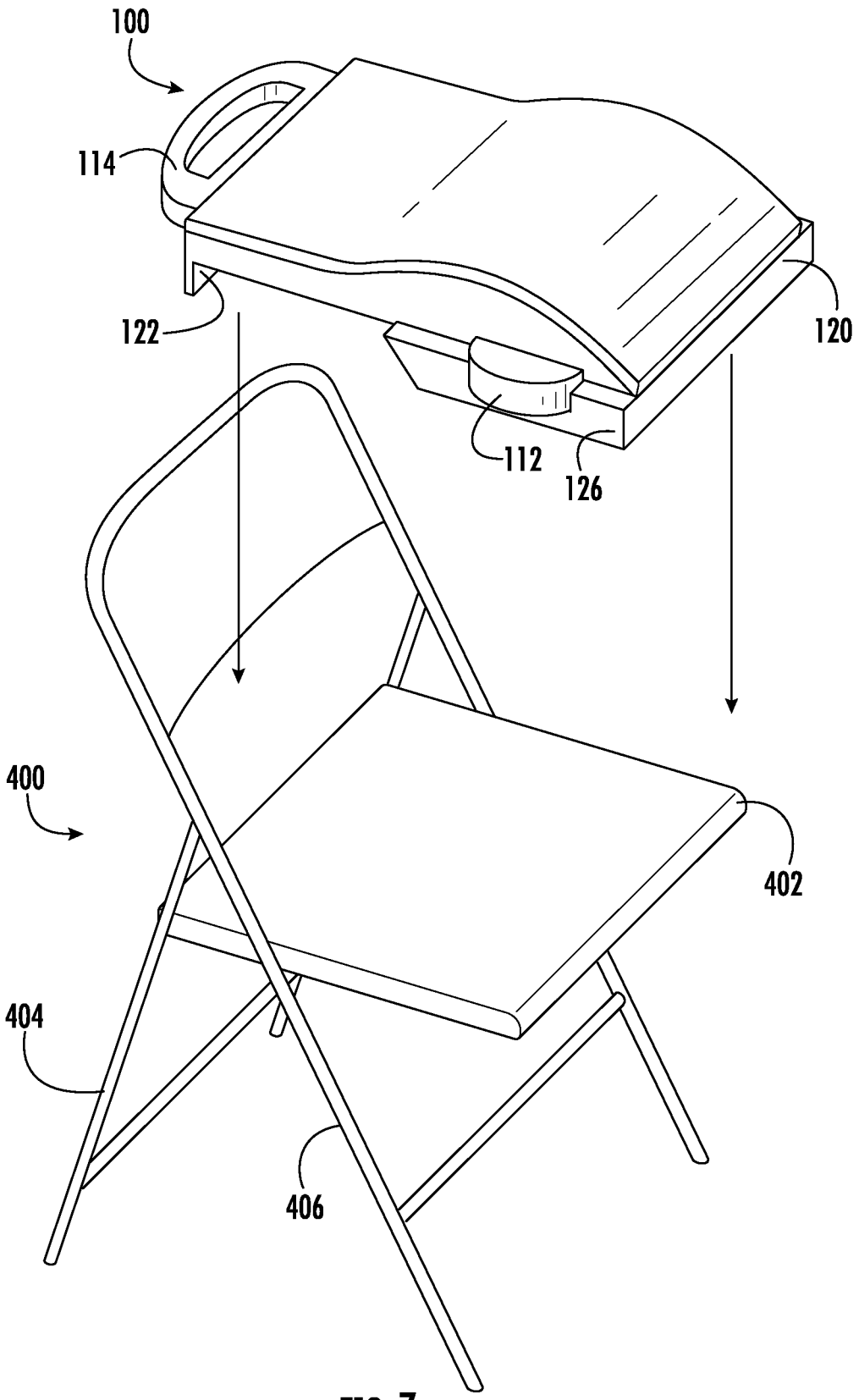
FIG. 7 illustrates one embodiment of the seating element engaged with a folding chair.

FIG. 7 illustrates one embodiment of the application over the seating element 100 relative to a standard metal folding chair 400. The standard metal folding chair 400 can be any number of pre-existing commercially available mass-produced metal folding chairs. While each individual chair manufacturer has separate sizing standards, these chairs all tend to fall within a standard sizing range and include both open and closed positions. The closed positions allow for ease of carry and storage, while the open position uses hinge elements so back legs abut against front legs and the seat folds open into a usable position.

The chair 400 is in the open position, the seat 402 extended outward and the legs 404, 406 secured together. Here, the seating element 100 then is simply placed over the seat 402, the descending front wall 120 and the descending back wall 122 (not fully visible) affix over the seat. Further securing the seating element 100 to the chair, the descending outer side walls 126 contain the side edges of the chair seat 402.

As visible in FIG. 7, the handle 114 extends outward from the seating element 100 behind the chair legs 404, 406. Thus, the user has easy access to the handle 114 during use.

Removal of the seating element 100 follows the reverse, simply being lifted off the chair seat 402 and out between the legs 404, 406.

The seating element may include further embodiments for secure engagement to the chair. For instance, one embodiment may include a strap or other element that runs across an underside of the seating element. When placed on a chair, the strap can be secured around an underside of the seat of the folding chair.

In varying embodiments, the seating element may include at least 2 of the edges or walls for secure engagement to a metal chair. In one embodiment, the element includes four points of engagement, one on each edge including front, back, left, and right. This embodiment can include descending front wall 120, descending back wall 122, the first outer side wall 126 and the second outer side wall, as noted in FIGS. 2 and 3 above. In another embodiment, the seating element may include only two or three points of engagement, from the optional engagement points, front, back, left side and right side. As the number of engagement points increases, the security of the attachment to the chair increases, but at least two engagement points are the minimal requirement for the secure engagement of the seating element to the chair and a seating element having only two points of engagement is within the scope of the invention herein.

Figure 8:
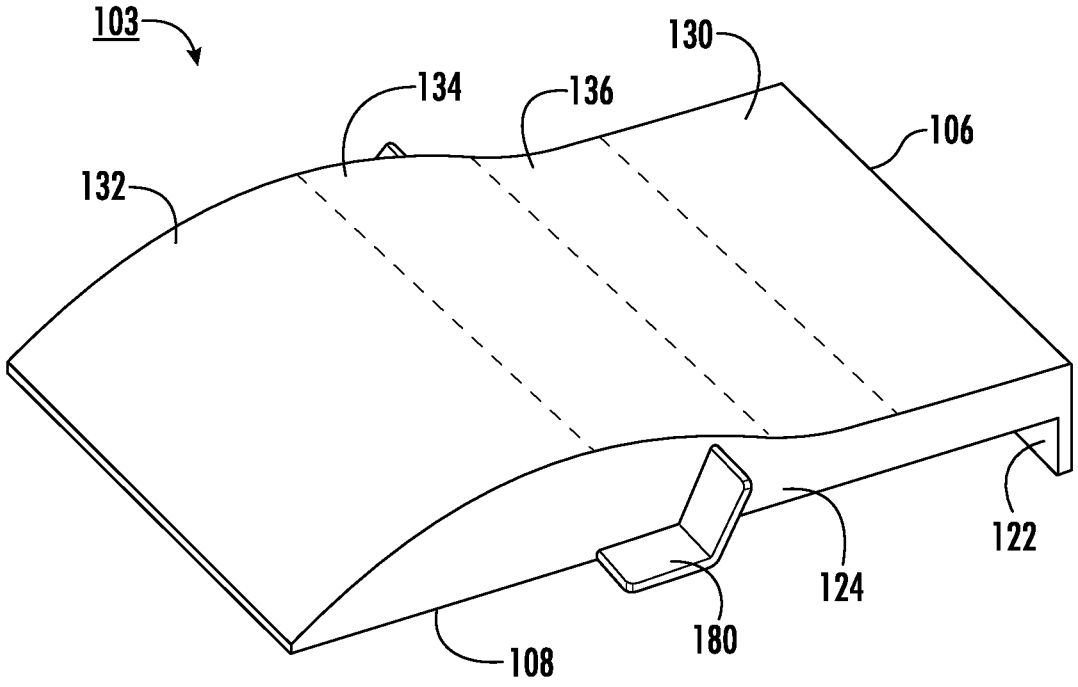
FIG. 8 illustrates another embodiment of a seating element.

In another embodiment, FIG. 8 illustrates a seating element 103 including limited points of engagement for quick engagement of and removal from a standard metal folding chair. This embodiment includes the top cover rising in the convex arcuate rise 132 from the front edge. The convex arcuate rise 132 crests and then descends 134 towards approximate front-to-back mid-point of the seat assembly 100 where it blends into the descending concave arcuate portion 136 that continues until it meets and blends into the flat portion 130 at a point approximately 13.125" from the front edge of the base portion.

Herein, the seating element includes the descending back wall 122 extending downward, as well as the first side edge 108 and the inner side wall 124. This embodiment may further include a second side edge and second side wall not visible due to the perspective view of FIG. 8.

In this embodiment, a leg stop 180 is affixed to and extends outward from the side wall 124. The opposing side wall can include a mirrored angled element. The leg stop 180 can be made of any suitable material as recognized by a skilled artisan, including in one embodiment the same material as the seating element 103 and/or the side wall 124.

In this embodiment, the leg stop 180 is positioned on the side wall 124 at a location to abut against the legs of the chair, such as legs 406 of FIG. 7. In this embodiment, the seating element 103 is secured to the chair based on the descending backwall 122 and the leg stops 180. Further embodiments can include insertion of the leg stops 180 with embodiments of FIGS. 1-2 above. Moreover, further embodiments can include inclusion of the leg stops 180 with the descending front wall 120 (FIG. 1).

In one embodiment, the leg stop 180 can extend outward from the side wall 124 a distance of between 0.75 to 1.5 inches with one embodiment extending outward by 1.125 inches. The leg stop 180 includes an angled element for matching the angle of the leg of chair, for example one embodiment including an angle of 30 degrees with variations in angles between 25 degrees to 35 degrees. In one embodiment, the leg step 180 includes a base or lateral element having a length of approximately 1 inch and the angled upward extending element having a length of approximately 1.25 inches. In one embodiment, the leg stop 180 can have a thickness of approximately 0.125 inches.

In one embodiment, the leg stop 180 is a separate element that is mechanically attached to one or both sidewalls 124 and is adjustable in a front-to-back range of approximately 1" for more secure attachment to chair legs 406.

FIGS. 1 through 8 are conceptual illustrations allowing for an explanation of the present invention. Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, Applicant does not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments so fully reveals the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein.

What is claimed is:

1. A seating element attachable to a metal folding chair, the seating element comprising:

a base portion having a front edge, a back edge, a first side edge and a second side edge, the base portion articulating in shape of a top surface from the front edge to the back edge including a convex arcuate rise and fall connected to a concave arcuate descension to the top surface of the base portion whereby the front edge of the base portion is lower in height than the back edge of the base portion;

at least two of:

a back wall disposed at the back edge extending downward therefrom;

a front wall disposed at the front edge extending downward therefrom;

a first outer side wall at the first side edge of the base portion; and a second outer side wall at the second side edge of the base portion, opposite the first side edge of the base portion;

wherein the convex arcuate rise and fall and at least a portion of the concave arcuate descension of the base portion are disposed before a midpoint between the front edge of the base portion and the back edge of the base portion and where the concave arcuate descension blends into a flat top surface of the base portion;

wherein the seating element is securable to the metal folding chair by engagement of the at least two of: the descending back wall, the descending front wall, the first outer side wall, and the second outer side wall over a seat of the metal folding chair and wherein the convex arcuate rise generates a downward slope between a range of 18 degrees and 22 degrees for the thighs of a user sitting on the seating element secured to the metal folding chair.

2. The seating element of claim 1 wherein the top front edge of the base portion is lower in height than the back top edge such that when disposed on the chair, the front edge rests at descending angle between 3.5 degrees and 6.5 degrees from the back edge.

3. The seating element of claim 1 further comprising at least one hand grip disposed on the first side edge or the second side edge and extending outward therefrom.

4. A seating element attachable to a metal folding hair, the seating element comprising:

a base portion having a front edge, a back edge, a first side edge and a second side edge;

a top of the base portion articulating in shape of the top surface from the front edge to the back edge including a convex arcuate rise and fall connected to a concave arcuate descension to the top surface of the base portion such that the front edge of the base portion is lower in height than the back edge of the base portion, wherein the convex arcuate rise and fall and at least a portion of the concave arcuate descension of the base portion are disposed before a midpoint between the front edge of the base portion and the back edge of the base portion where the concave arcuate descension blends into a flat top surface of the base portion;

a descending back wall disposed at the back edge extending downward therefrom;

a descending front wall disposed at the front edge extending downward therefrom;

a first inner side wall at the first side edge of the base portion;

a second inner side wall at the second side edge of the base portion, opposite the first side edge of the base portion; and wherein the seating element is securable to the chair by engagement of the back wall and the front wall over a seat of the metal folding chair and wherein the convex arcuate rise generates a downward slope between a range of 18 degrees and 22 degrees for the thighs of a user sitting on the seating element secured to the metal folding chair.

5. The seating element of claim 4, wherein the seating element is further securable to the chair by the engagement of the first outer side wall and the second outer side wall over the seat of the chair.

6. The seating element of claim 4 further comprising:

the rearward edge of the outer sidewalls is angled forwardly downward at an angle of 30 degrees such that it does not interfere with the front legs of the metal folding chair to which it is attached.

7. The seating element of claim 4 further comprising:

a compression element disposed on top of the seating element extending from the front edge to the back edge.

8. The seating element of claim 7, wherein the compression element is removeable.

9. The seating element of claim 4 further comprising:

at least one handle extending outward from the back wall.

10. The seating element of claim 4 further comprising a first hand grip and a second hand grip, wherein the first hand grip is disposed on the first inner side wall and/or a first outer side wall and the second hand grip is disposed on the second inner side wall and/or a second outer side wall.

11. A seating element attachable to a metal folding chair, the seating element comprising:

a base portion having a front edge, a back edge, a first side edge and a second side edge;

a first outer side wall parallel to and descending from the first side edge and a second outer side wall parallel to and descending from the second side edge;

a top of the base portion articulating in shape from the front edge to the back edge including a convex arcuate rise and fall connected to a concave arcuate descension to the flat top surface of the base portion such that the front edge of the base portion is lower in height than the back edge of the base portion;

wherein the convex arcuate rise and fall and at least a portion of the convex arcuate descension of the base portion are disposed before a midpoint between the front edge of the base portion and the back edge of the base portion and wherein the concave arcuate descension blends into a flat top surface of the base portion such that the convex arcuate rise and fall generates a downward slope between a range of 18 degrees and 22 degrees for the thighs of a user sitting on the seating element secured to the metal folding chair;

a back wall disposed at the back edge extending downward therefrom;

at least one carrying handle extending outward from the back wall;

a front wall disposed at the front edge extending downward therefrom; and wherein the seating element is securable to the chair by engagement of the back wall, the front wall, the first outer side wall, and the second outer side wall over a seat of the metal folding chair.

12. The seating element of claim 11, wherein the front edge of the base portion is lower in height than the back edge such that when disposed on the chair, the front edge rests at an angle between plus 3.5 degrees to plus 6.5 degrees from the back edge.

13. The seating element of claim 11, wherein the space between the first outer side wall and the second outer side wall is not less than 16.125 inches.

14. The seating element of claim 11 further comprising:

a first hand grip disposed on the first side wall and a second hand grip disposed on the second side wall.

15. A seating element attachable to a metal folding chair, the seating element comprising:

a base portion having a front edge, a back edge, a first side edge and a second side edge, the base portion articulating in shape of a top surface from the front edge to the back edge including a convex arcuate rise and fall connected to a concave arcuate descension to the flat top surface of the base portion whereby the front edge of the base portion is lower in height than the back edge of the base portion;

back wall disposed at the back edge extending downward therefrom;

a side wall at the first side edge of the base portion;

a second side wall at the second side edge of the base portion, opposite the first side edge of the base portion;

a first leg stop disposed on and extending outward from the first side edge; and a second leg stop disposed on and extending outward from the second side edge;

wherein the seating element is securable to the chair by engagement of the back wall, the first leg stop, and the second leg stop to the metal folding chair.

16. The seating element of claim 15, wherein the convex arcuate rise and at least a portion of the convex arcuate descension of the base portion are disposed before a midpoint between the front edge of the base portion and the back edge of the base portion where it blends into a descending concave arcuate portion that blends into the flat top surface of the base portion, the seating element further comprising:

at least one handle extending outward from the back wall.

* * * * *